US005950911A

United States Patent [19]

Naughton et al.

[11] Patent Number: 5,950,911

[45] Date of Patent: Sep. 14, 1999

[54] DEVICE FOR HOLDING A PLURALITY OF CONTAINERS

[75] Inventors: William J. Naughton; Neil E. Darin, both of Spartanburg, S.C.; Martin K. Harrelson, Tupelo, Miss.; John R. Boutin, Youngsville, La.; Greg K. Williams, Kingwood, Tex.; Roger A. Brotz, Bolingbrook, Ill.

[73] Assignee: Union Camp Corporation, Princeton, N.J.

[21] Appl. No.: 09/098,813

[22] Filed: Jun. 17, 1998

Related U.S. Application Data

[60] Provisional application No. 60/050,168, Jun. 19, 1997.

[51] Int. Cl.[6] ..... B65D 5/488

[52] U.S. Cl. ..... 229/109; 229/120.18; 229/122.3; 229/164

[58] Field of Search ..... 229/109, 120.18, 229/122.27, 122.3, 164; 206/427, 431

[56] References Cited

U.S. PATENT DOCUMENTS

| | | | |
|---|---|---|---|
| 210,887 | 12/1878 | Williams | 229/109 |
| 2,989,225 | 6/1961 | Waldrop | 229/122.27 |
| 3,185,379 | 5/1965 | Kohlhass | 229/122.27 |
| 3,365,109 | 1/1968 | Kessler et al. | 229/122.3 |
| 4,607,750 | 8/1986 | Valenti | 206/427 |
| 4,676,429 | 6/1987 | Crowe et al. | 229/109 |
| 5,372,299 | 12/1994 | Edgerton, Jr. et al. | 229/164 |
| 5,487,504 | 1/1996 | Baird | 229/164 |
| 5,758,818 | 6/1998 | Ewing, Jr. | 229/122.3 |

*Primary Examiner*—Gary E. Elkins
*Attorney, Agent, or Firm*—Watov & Kipnes, P.C.

[57] ABSTRACT

A device for holding a plurality of containers of any shape which employs a base and opposed side support sections extending upwardly from the base having a back portion positioned against the side walls of the base and an extension extending inwardly into a storage area to provide a device for storing and displaying the containers which can be viewed and removed from the side of the device.

12 Claims, 3 Drawing Sheets

DEVICE FOR HOLDING A PLURALITY OF CONTAINERS

This application claims benefit of Provisional Application 60/050,168 filed Jun. 19, 1997.

FIELD OF THE INVENTION

The present invention is directed to a device for holding a plurality of containers such as gallon containers for holding liquids or solids such as household cleaning products. The device is constructed with a pair of side support sections which provide sufficient support to hold the containers while allowing greater visibility of the containers and greater ease in removing the containers from the device even when the devices are stacked one upon the other.

BACKGROUND OF THE INVENTION

Devices for storing and displaying containers of liquid or solid products, especially household products such as cleaning fluids, bleach and the like are known in the art. The devices typically comprise a base with upwardly extending sidewalls to provide support at opposed sides of the device. There is also provided an insert within the container that is used to provide additional support.

The typical insert is in the shape of the letter "H" and includes panels which extend from opposed sides of the device to thereby form storage compartments for the individual containers. This type of design suffers from two major disadvantages. First, because the panels extend from one side of the device to the other, a portion of the storage area is blocked from view. Therefore, even if a portion of the sides of the device are removed a consumer looking through the exposed portion of the side may see less than all of the containers or may not see any containers even though several containers may still remain within the storage area.

The second disadvantage of the "H" insert is that the containers cannot be easily removed from the side of the device. Instead, the containers must be removed from the top of the device. This reduces access to the containers because the user must be able to get above the device to remove the containers stored therein especially relatively heavy containers such as gallon containers of liquid or solid product. In addition, the removing of the containers by consumer is rendered much more difficult and cumbersome.

As previously indicated, the conventional "H" insert is customarily employed in such devices because it adds significant structural strength to the device so that the same can be stacked without damage and can safely undergo the rigors of shipping.

It would therefore be a significant advance in the art of storage devices, especially storage devices for storing and displaying containers of liquid or solid products if a strong storage device could be fabricated which enabled visibility of the stored containers while enabling removal of the containers through the sides of the storage device.

It would be a further advance in the art of storage devices to provide a device which can be easily stacked one upon the other during shipment and/or for displaying the contents therein for consumer purchase.

It would be a further significant advance in the art of storage devices, particularly for containers storing liquid or solid products, if the "H" type insert could be eliminated without sacrificing the structural integrity of the device.

SUMMARY OF THE INVENTION

The present invention is generally directed to a device for storing containers, typically containers of any shape or size for housing liquid or solid commercial products such as household cleaners, so that the same may be safely stored and displayed. In accordance with the present invention, the storage device provides structural integrity so that devices filled with containers can be stored one on top of the other and provide a convenient display as well as ready access to the containers to facilitate purchase by the consumer.

More specifically, the present invention is directed to a device for holding a plurality of containers comprising:

(a) a base having a floor portion and first and second opposed pairs of walls extending upwardly from the floor portion;

(b) opposed side support sections extending upwardly from the floor, each of said support sections comprising a back portion secured against one of the walls of the first pair of opposed walls and respective side portions secured against a portion of the respective walls of the second pair of walls, said base and said opposed side support sections defining a storage area for said containers; and (c) an inwardly facing projection extending inwardly into the storage area from each of the back portions.

The device of the present invention can be constructed in a variety of shapes to accommodate a plurality of containers. The device may be provided with a platform or cover to enable one device to be placed upon another for storage and display purposes.

BRIEF DESCRIPTION OF THE DRAWINGS

The following drawings in which like reference characters indicate like parts are illustrative of embodiments of the invention and are not intended to limit the invention as described herein.

DETAILED DESCRIPTION OF THE INVENTION

Figure 1:
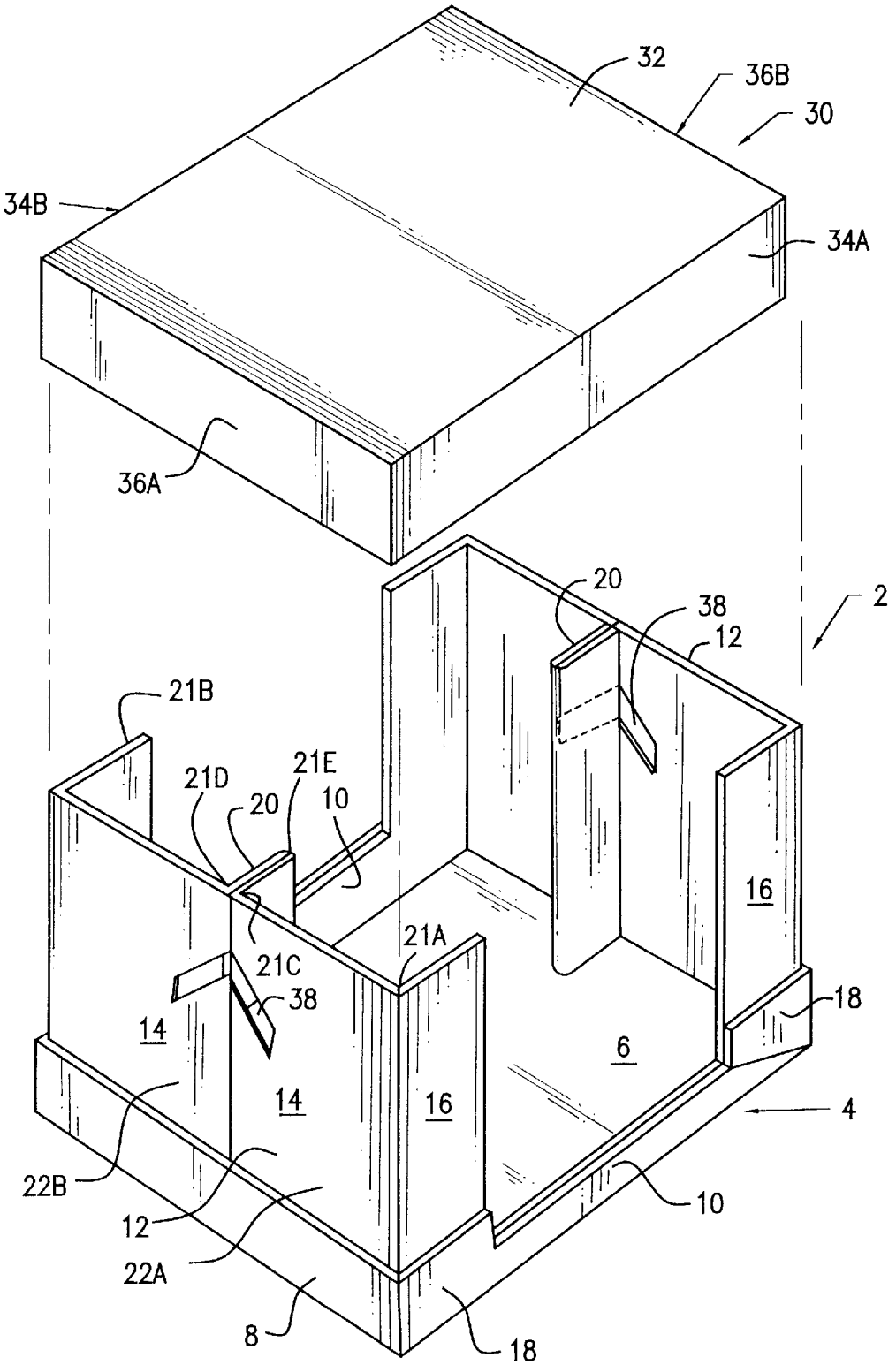
FIG. 1 is an exploded perspective view of one embodiment of the device in accordance with the present invention.
Figure 2:
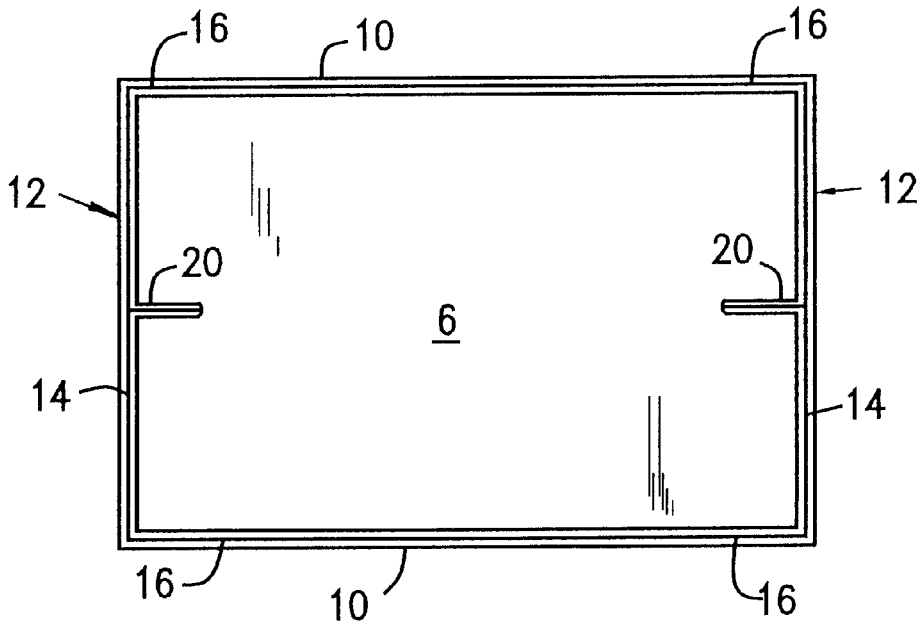
FIG. 2 is a plan view of the embodiment of the invention shown in FIG. 1.
Figure 3:
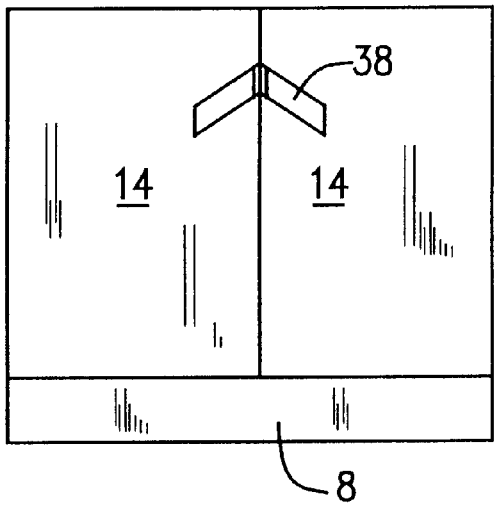
FIG. 3 is a side view of the embodiment of the invention shown in FIG. 1.

Referring to the drawings and particularly to the embodiment shown in FIGS. 1–3, there is shown an embodiment of the present invention in which the device 2 includes a base 4 having a floor portion 6, a first pair of side walls 8 (only one side wall is shown) and a second pair of side walls 10.

Attached to the first pair of side walls 8 are respective side support sections 12 comprising a back portion 14 and opposed side portions 16. The side support sections 12 are secured against and are contiguous with the first pair of the side walls 8 and a portion 18 of the second pair of side walls 10.

In accordance with the present invention, extending inwardly into the storage area from the back portion 14 is an extension 20 which provides additional support for the device, yet does not take up nearly as much room or interfere with the line of sight into the device as the prior art "H" type of insert.

The extension 20 may be constructed separate from the back portion 14 and then attached thereto by mechanical means such as staples or the like or by adhesive means such as by glues, adhesives and the like suitable for bonding the back portion 14 and the extension 20 together. The adhesive means suitable for this purpose would be known to those skilled in the art.

In a preferred form of the invention the entire side support sections including the extension are constructed from a single piece of material such as corrugated board. Referring specifically to FIGS. 1 and 3, the side support sections 12 comprising the back portions 14, the side portions 16 and the extension 20 are constructed from a continuous, single piece of material. As gleaned from FIG. 1, a blank is folded or molded to have corners 21A and 21B connecting the respective side portions 16 to the back portions 14. Corners 21C and 21D are provided to connect the back portions 14 to the extension 20. The extension 20 is completed by folding the material used to construct the back portion 14 upon itself at the point 21E. As a result, the component parts of the side support sections 12 are integral which adds strength to the device over construction in which the component parts are constructed separately and connected through mechanical and/or adhesive means.

As best shown in FIG. 1, the back portion 14 can be formed from two components 22A and 22B. In a preferred form of the invention two adjacent side portions 16 of the respective components 22A and 22B are secured together such as by gluing to form the inwardly extending extension 20. The extension 20 itself can be glued to the floor 6 of the device to provide additional structural integrity for the device 2.

The side support sections 12 are positioned only in proximity to the first pair of side walls 8. The second pair of side walls 10 do not have side support sections and therefore provide a line of sight from either side of the device into the storage area. Side support sections are not needed for the second pair of side walls 10 because the side support sections 12 provide sufficient strength and support for the device even for storing and displaying relatively heavy containers of liquid or solid product.

The device 2 of the present invention may be provided with a cover which can serve a dual purpose. First, the cover provides a flat surface enabling another such device to be placed upon the cover to stack one device upon another. A second advantage of the cover is to provide a means for protecting the containers.

Referring to FIG. 1, a cover 30 is shown having a top side 32 and a pair of opposed sides 34A and B and 36A and B. The cover is dimensioned so that it, preferably, fits over and snugly nestles about the side support sections 12 of the device. When the cover 30 is included as part of the device, the top side 32 provides a flat surface upon which another such device can be placed thereon to provide a stacked series of devices each containing a plurality of containers. The presence of the side support sections 12 and the inwardly extending extension 20 provide the requisite structural integrity to enable the devices to maintain their shape and to protect the containers therein when stacked one upon the other. It will be understood that the cover can have a variety of shapes which would be apparent to those skilled in the art.

The device 2 may be provided with some means for facilitating the carrying of the device, especially when loaded with a plurality of containers. For example, as specifically shown in FIG. 1, the device 2 has in the respective back portions 14, an opening 38 of sufficient size and shape to enable a person to effectively insert their hand within the device. The shape of the opening 38 can be tailored to fit the palm of the user.

As shown in FIGS. 1–3, the shape of the device is rectangular. The device can also be made in the shape of a square or in the shape of a polygon as described hereinafter.

Figure 4:
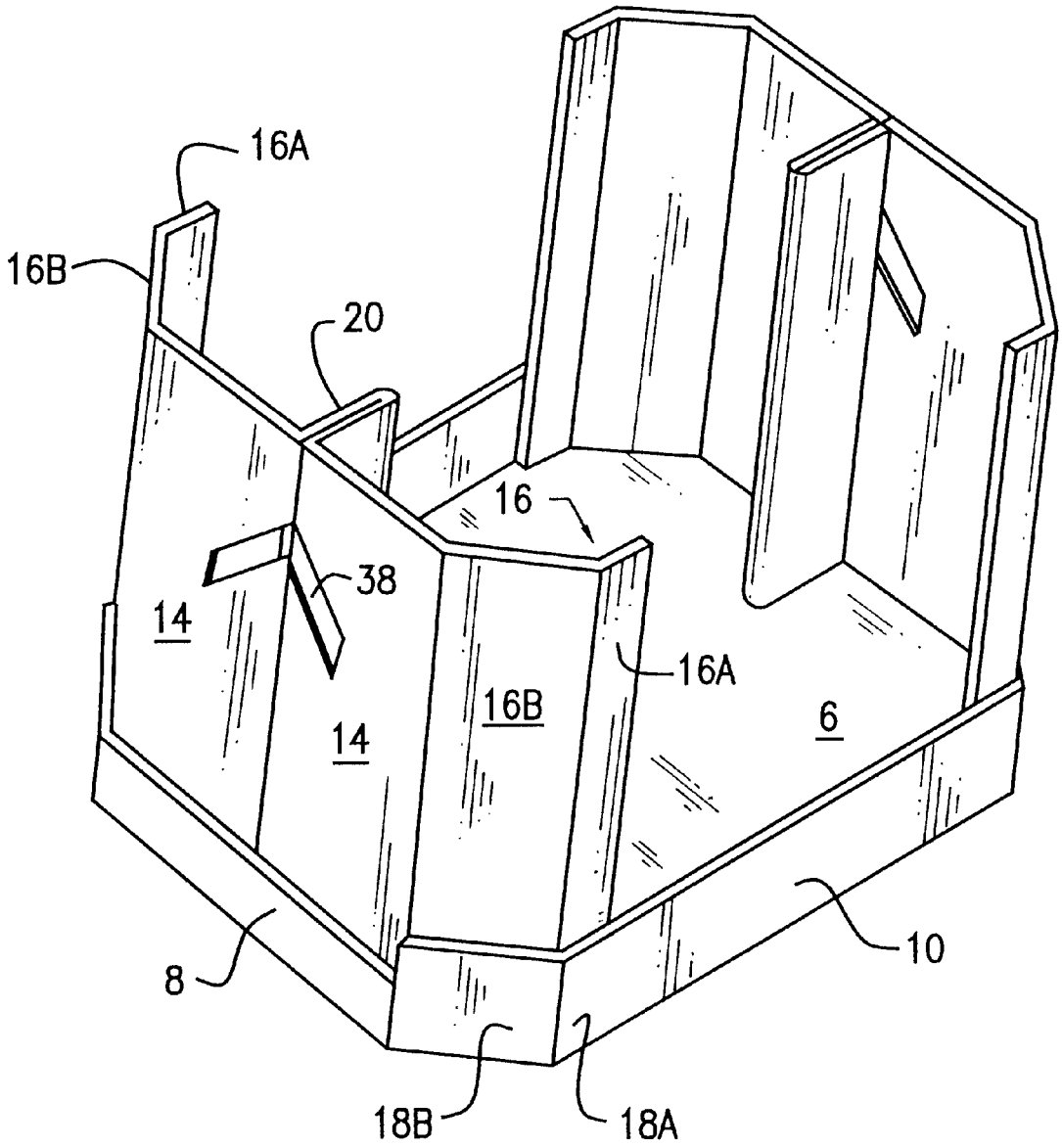
FIG. 4 is a perspective view of another embodiment of the device of the invention.

In another embodiment of the invention, the device 2 can be formed in the shape of a polygon such as an octagon as specifically shown in FIG. 4. As shown in FIG. 4, the device 2 includes respective side support sections 12 each comprised of respective back portions 14 and an inwardly extending extension 20 as described in connection with the embodiment of FIGS. 1–3.

In the present embodiment, the side portions 16 are comprised of two panels 16A and 16B. The panel 16B is contiguous with the side wall 10 while the panel 16A provides a connection between the panel 16B and the back portion 14. The panel 16B lies at an angle with respect to panel 16A and back portion 14 and thereby provides the additional sides necessary to give the device an octagonal shape.

The modification of the side support sections 12 shown in FIG. 4 is accommodated by a similar modification to the side walls. In particular, the portion 18 of the side walls 10 is divided into a first portion 18A which is contiguous with the panel 16A and a second portion 18B which is contiguous with the panel 16B described above. As a result, the side sections 12 and the side walls 10 are closely aligned in a supporting relationship to provide structural integrity to the device.

It will be understood that other shapes may be employed in accordance with the present invention depending, in part, on the number and shapes of the containers to be stored within the device. The size of the device may be varied depending on the size of the containers. Accordingly, the device of the present invention can be used to store containers containing, for example, liquid or solid household products, automotive products, food products and the like. The shape of the container which can be stored by the present device can vary widely and include round containers, polygon shaped containers and irregular shaped containers.

The device 2 may be constructed of a variety of materials including but not limited to paper-based products such as corrugated board; plastics; composites; metals and the like. In the case of paper-based products, for example, the device can be fabricated from precut blanks as is customary in the corrugated container industry. Alternatively, the device may be formed from a mold such as when the construction material is a plastic. Other methods of manufacturer would be apparent to those of ordinary skill in the art.

What is claimed is:

1. A device for holding a plurality of containers, comprising:

(a) a base comprising a floor portion and first and second opposed pairs of walls extending upwardly from the floor portion;

(b) opposed side support sections extending upwardly from the floor, each of said support sections comprising a back portion positioned against one of the walls of the first pair of opposed walls and respective side portions positioned against a portion of the respective walls of the second pair of walls, said base and said side support sections defining a storage area for said containers; and (c) an extension extending from the back portion into the storage area.

2. The device of claim 1 further comprising a cover extending over the opposed side support sections.

3. The device of claim 1 wherein the side support sections are constructed from a single, continuous piece of material.

4. The device of claim 1 wherein the second opposed pair of walls together with the side support sections define an opening enabling a person to see the containers stored within the storage area through said opening.

5. The device of claim 1 wherein the side support sections comprise a back portion and a side portion extending perpendicular to the back portion.

6. The device of claim 5 wherein the device is in the shape of a rectangle.

7. The device of claim 1 wherein the side support sections comprise a back portion and a side portion comprised of at least two panels with one of said panels extending from another of said panels to the back portion.

8. The device of claim 1 wherein the device is in the shape of a polygon.

9. The device of claim 1 wherein the device is in the shape of an octagon.

10. The device of claim 1 wherein the device is made of a material selected from the group consisting of paper-based products, plastics, composites and metals.

11. The device of claim 1 wherein the paper based product is a corrugated board.

12. The device of claim 1 wherein the side support sections are affixed to the floor portion.

* * * * *